US005474464A

United States Patent [19]

Drewnicki

[11] Patent Number: 5,474,464

[45] Date of Patent: Dec. 12, 1995

[54] ELECTRICAL ADAPTOR

[75] Inventor: Richard Drewnicki, Leicestershire, United Kingdom

[73] Assignee: Rutland Gilts Limited, London, Great Britain

[21] Appl. No.: 204,268

[22] PCT Filed: Sep. 9, 1992

[86] PCT No.: PCT/GB92/01643

§ 371 Date: Mar. 8, 1994

§ 102(e) Date: Mar. 8, 1994

[87] PCT Pub. No.: WO93/05552

PCT Pub. Date: Mar. 18, 1993

[30] Foreign Application Priority Data

Sep. 10, 1991 [GB] United Kingdom ..... 9119290

[51] Int. Cl.[6] ..... H01R 29/00

[52] U.S. Cl. ..... 439/172; 439/143

[58] Field of Search ..... 439/52, 53, 168–175, 439/189, 217–224, 143

[56] References Cited

U.S. PATENT DOCUMENTS 2,994,849 8/1961 Mussari, Jr. ..... 439/105

5,178,548 1/1993 Fortmann et al. ..... 439/52

FOREIGN PATENT DOCUMENTS 0156076 12/1984 European Pat. Off. .
3109620 9/1982 Germany .
8604457 7/1986 WIPO .
8704570 7/1987 WIPO .

*Primary Examiner*—Neil Abrams
*Attorney, Agent, or Firm*—Lowe, Price, LeBlanc & Becker

[57] ABSTRACT

An electrical adaptor or connector (1) comprising a housing (2), a carrier member (5) rotatably mounted on the housing, a plurality of selectable pin arrays (7) disposed on the carrier member and adapted whereby rotation of the carrier relative to the housing brings the pin arrays into their operative condition one at a time, a plurality of socket arrays (6) on the housing and an apertured member (4) rotatably mounted on the housing whereby rotation of the member (4) brings a selected one of the plurality of socket arrays (6) into an operative condition, one at a time. The member (4) is held in each indexed position by detent member (15). The pins of the plurality of selectable pin arrays (7) are pivotally mounted on the carrier member (5) so that they can be moved from a retracted inoperative position to an outwardly extended position in which they also become electrically connected to the socket array.

7 Claims, 5 Drawing Sheets

ELECTRICAL ADAPTOR

TECHNICAL FIELD

The invention relates to an electrical adaptor or connector of the kind used by international travellers to enable the connection of electrical appliances conforming to one standard of plug configuration to electrical outlets or sockets formed to receive plug conforming to a different standard.

BACKGROUND ART

It is known to provide such devices, see for example European Patent—B-0156076.

It is an object of the invention to provide a device of the kind aforesaid which is relatively simple in construction but which nevertheless enables a greater range of permutations than was heretofore available.

DISCLOSURE OF INVENTION

According to the invention there is provided an electrical connector comprising a housing having at one end a plurality of selectable pin arrays and at the other end a socket array, characterised by a carrier member on which the plurality of pin arrays is disposed, the carrier member being adapted to be mounted on the housing in a plurality of relatively rotated positions to bring the pin arrays into a position in which they can be moved into their operative condition one at a time. Preferably an apertured member is mounted on the said other end of the housing, the apertured member being adapted to be mounted on the housing in a plurality of relatively rotated positions to bring a plurality of socket arrays into an operative condition one. at a time. If desired the different socket combinations and/or the different connecting pin combinations may be brought into use by relative rotation between the body and disc-like members rotatable mounted at the ends of the cylindrical body. Alternatively disc-like members at the ends of the main body member may be detached and reconnected to the main body member (e.g. by plug and socket connections) in different rotational orientations to bring the different sockets and/or pins into operation.

Preferably the axial length of the cylindrical body is relatively short in comparison with its diameter to reduce its overhang in use in a wall socket and to improve the connection between the adaptor and the wall socket. In this connection it is a disadvantage of some known travel plugs that they are relatively long so that the inherent weight of the device causes them to tend to pull out of connection in use. This relatively short axial length may be achieved by arranging the connecting pins, when not in use, to be disposed transverse to the longitudinal axis of the adaptor and to be movable into a working position in which they extend in a substantially axial direction from one axial end of the adaptor body.

If desired a voltage transformer may be provided e.g. in the body or in a separate cylindrical housing which can be connected to the cylindrical body of the adaptor, to adapt the voltages of electrical appliances to that of the local country of use. Preferably the transformer will be capable of both stepping up the operating voltage or stepping down the voltage as is required simply by plugging it to the adaptor differently e.g. at opposite ends. The adaptor may be fused if desired. Preferably the device will have four or more socket configurations and four or more pin configurations. The adaptor may be arranged to prevent the use of certain permutations of socket and plug e.g. U.K. configuration in to U.K. configuration out and the like.

BRIEF DESCRIPTION OF DRAWINGS

The invention is diagrammatically illustrated, by way of example, in the accompanying drawings in which.

BEST MODE FOR CARRYING OUT THE INVENTION

Figure 1:
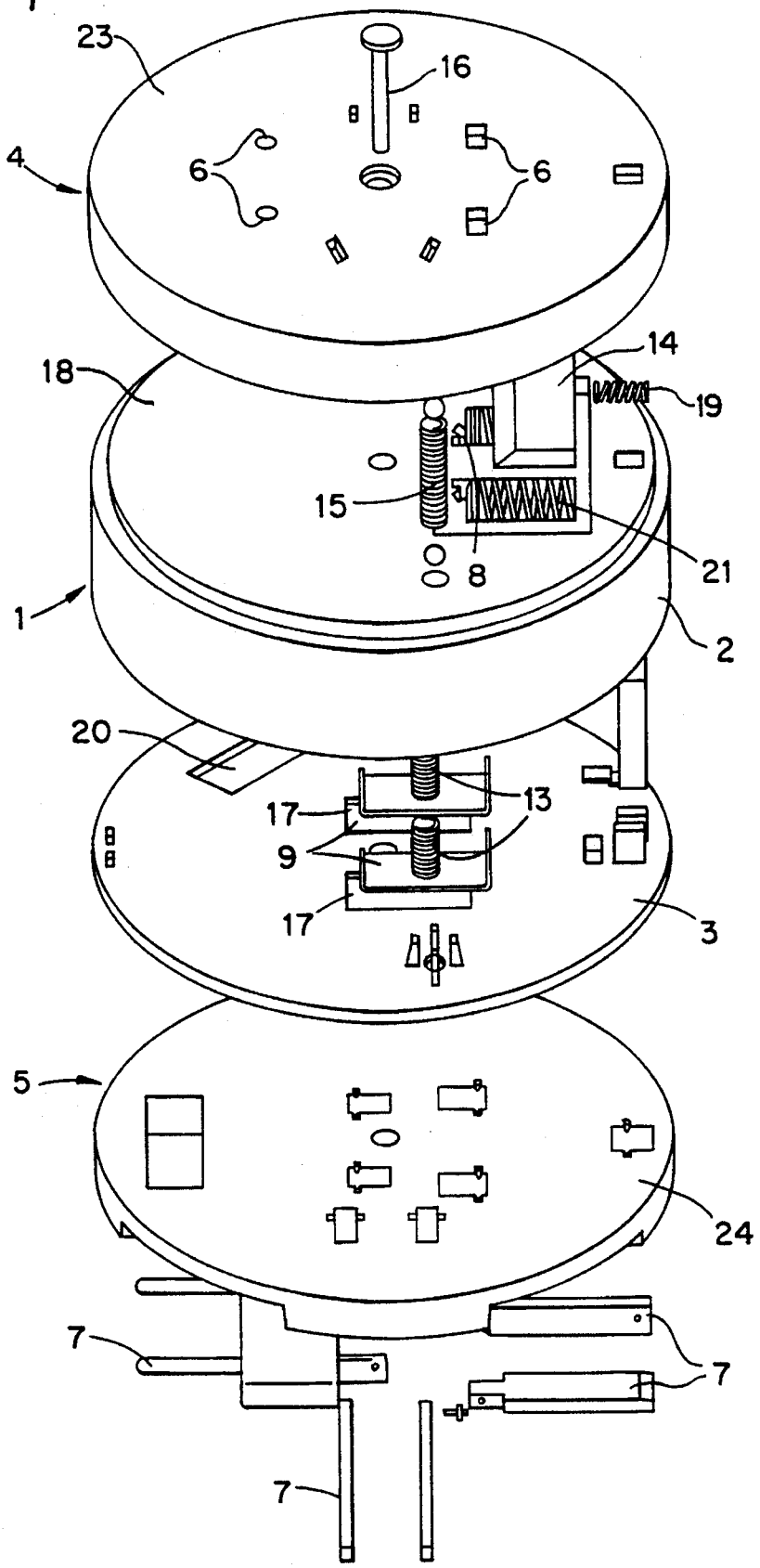
FIG. 1 is an exploded perspective view of one embodiment of electrical adaptor in accordance with the invention.

In the drawings there is shown an electrical adaptor or travel plug 1 moulded from plastics and consisting of a main cylindrical housing or body 2, the opposite axial ends of which adaptor are respectively formed as a four-way socket 4 and as a four-way plug 5. The body is of relatively large diameter in relation to its axial length so that, in use, it does not overhang from a wall socket to an extent such that it tends to pull out of the socket under its own weight.

The cylindrical body 2 is hollow and houses first and second sets of electrical contacts 8 and 9 respectively which are spring loaded by means of contact springs 21 and 13 respectively, (which may be coil springs but are preferably leaf springs) the contacts being mounted in box-like formations 22 (see FIG. 2) moulded integrally into the interior of the cylindrical body 2. The cylindrical body 2 is closed by a disc-like cover member 3 formed with apertures 17 through which the second set of contacts 9 are exposed. The first set of contacts 8 are exposed via corresponding apertures formed in the end wall 18 of the cylindrical body and covered by a shutter 14 urged by a spring 19 to cover the said first contacts. The first and second sets of contacts are connected together by means of an electrical connection 11 which connects together the neutral first and second contacts and by an electrical connection 12 which connects the first and second live contacts. In the case of the live connection a fuse and holder assembly 10 is interposed in the electrical connection 12 and is accessible through an aperture 20 in the cover 3. Means (not shown) are provided to fix the cover 3 stationarily against the body whereby the body and cover are not relatively rotatable. This means may take any suitable form, e.g. a projection engaging a notch for example.

The socket end 4 and the plug pin end 5 of the adaptor are formed as respective disc-like plates 23, 24 which are rotatable on the body about a centrally disposed pivot pin 16, (see FIG. 1). A detent member 15 is mounted in a cavity in the body 2 and comprises a compression spring which urges balls located at its respective ends into contact with detent recesses in the disc-like plates 23, 24 whereby the plates can be positively indexed through increments of 90° with respect to the body 2 to bring the respective sets or arrays of sockets and respective sets or arrays of plug pins into their operative positions in which they are aligned with the respective sets of contacts 8 and 9.

Figure 2:
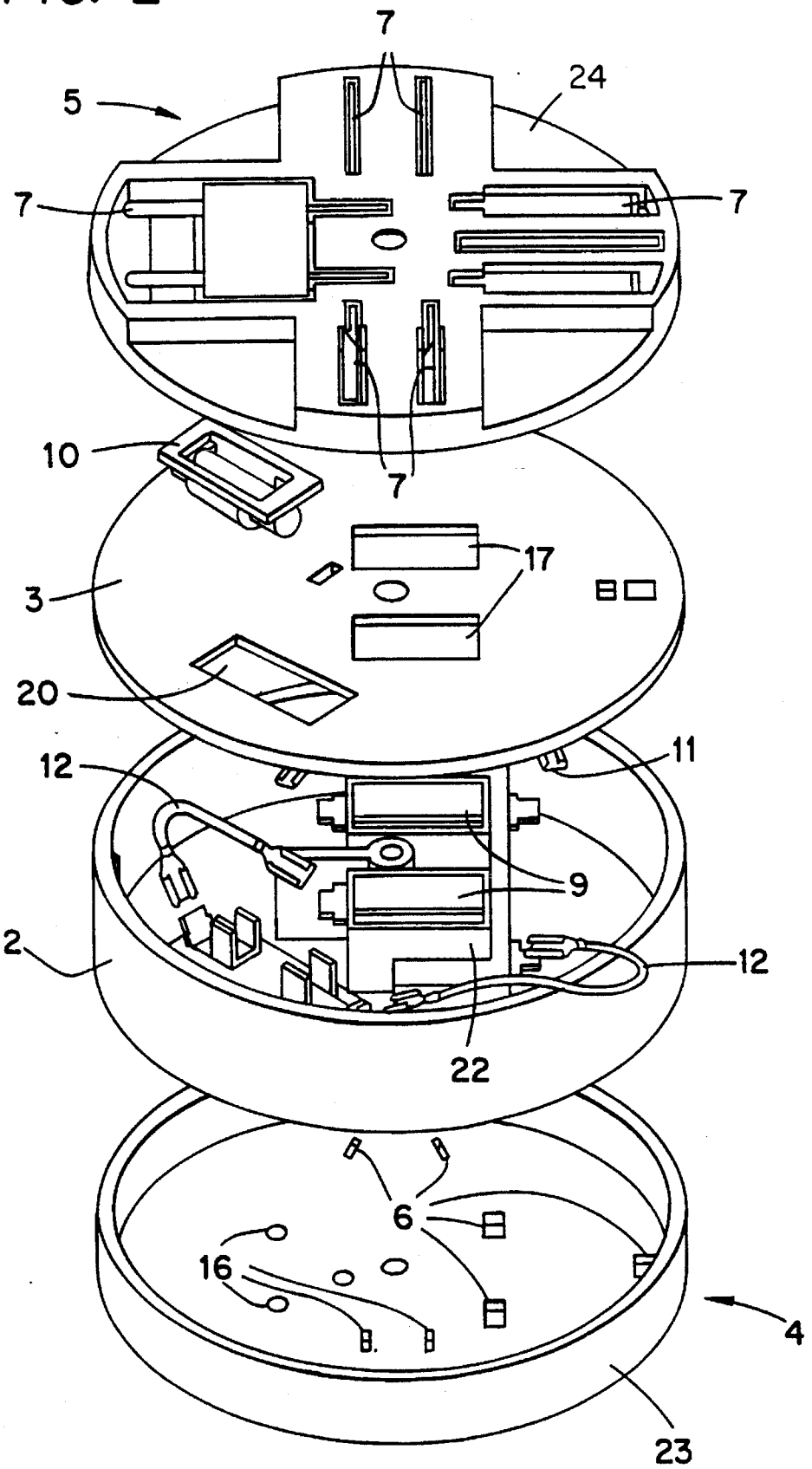
FIG. 2 is an exploded perspective view of the adaptor of FIG. 1 taken from the opposite end.
Figure 3:
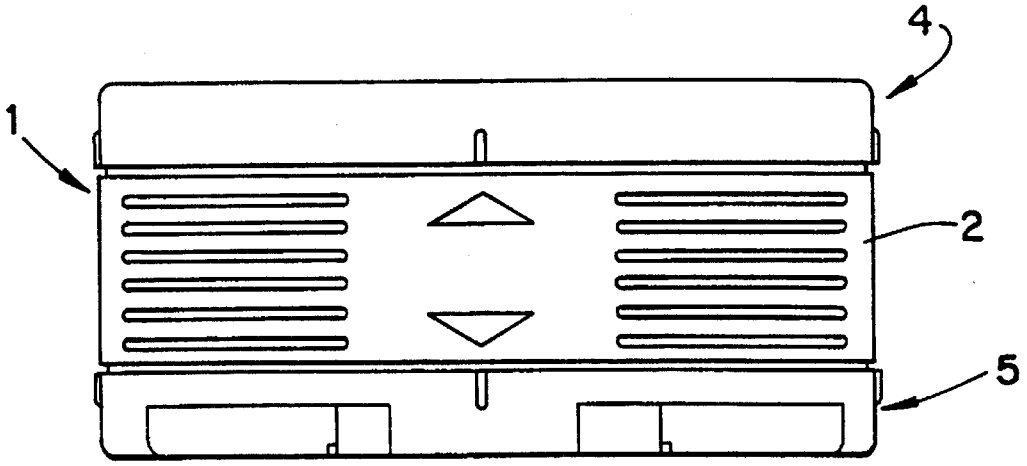
FIG. 3 is a side view of the electrical adaptor of FIGS. 1 and 2.
Figure 4:
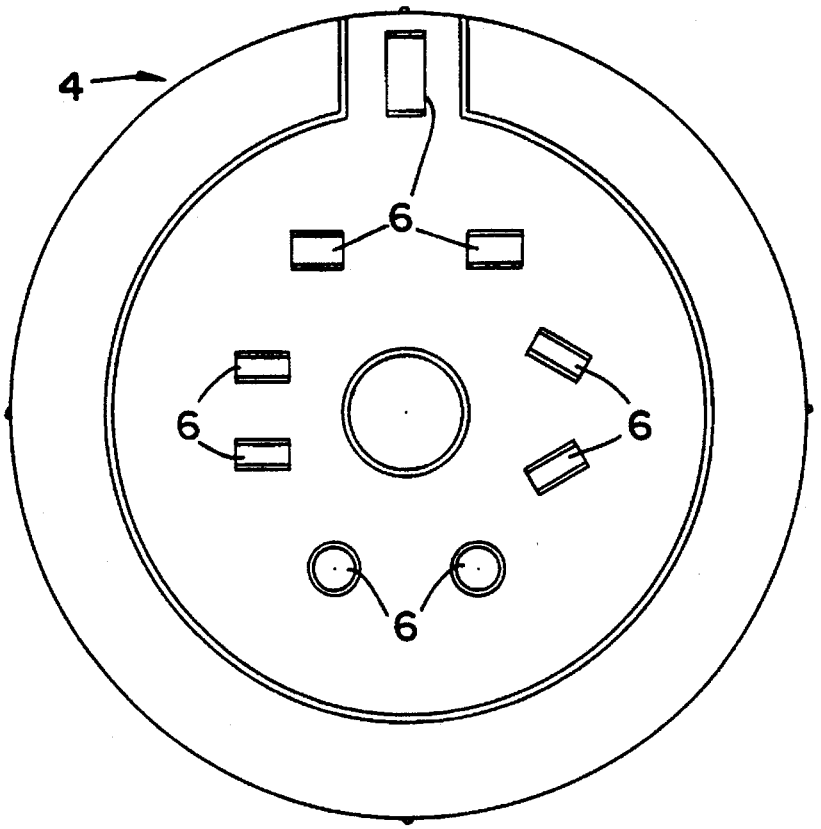
FIG. 4 is an end view of the adaptor of FIGS. 1 to 3.
Figure 8:
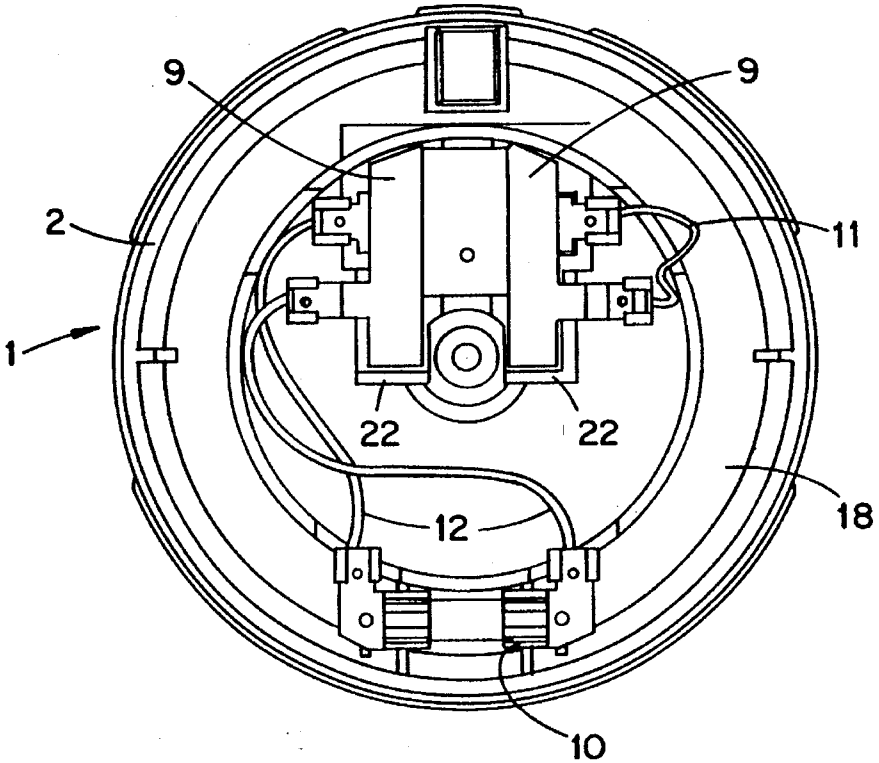
FIG. 8 is an interior view of the adaptor viewed in the same sense as FIG. 5, with the carrier member and cover removed.
Figure 5:
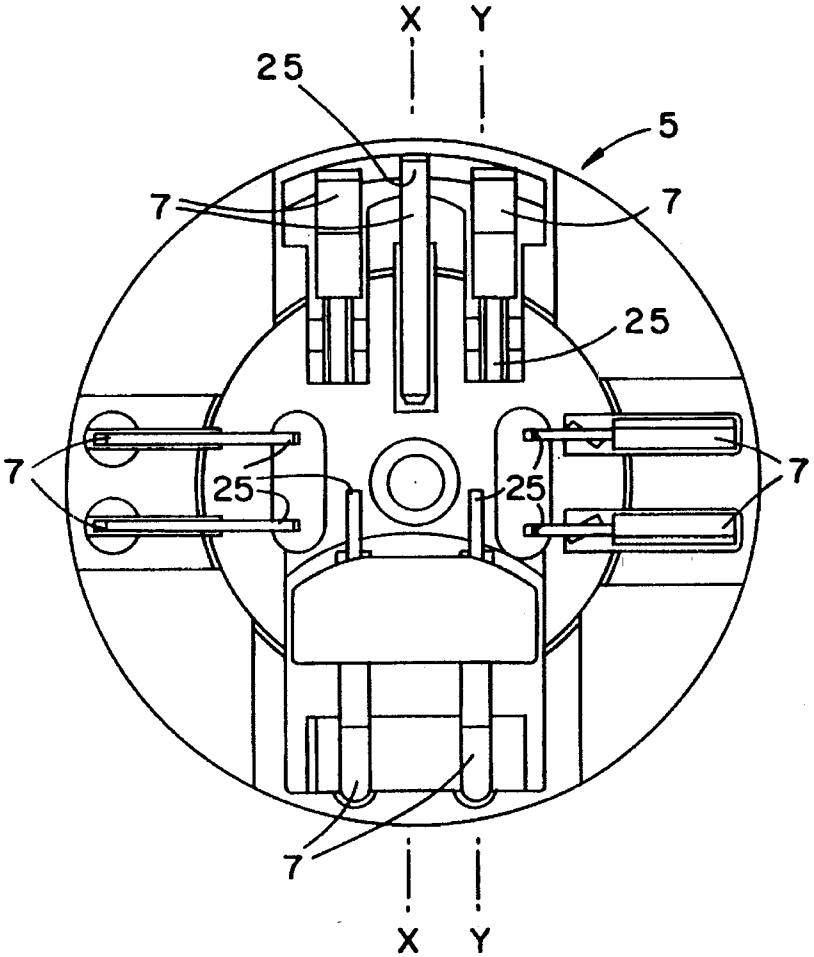
FIG. 5 is a view of the other end of the adaptor of FIGS. 1 to 3.
Figure 6:
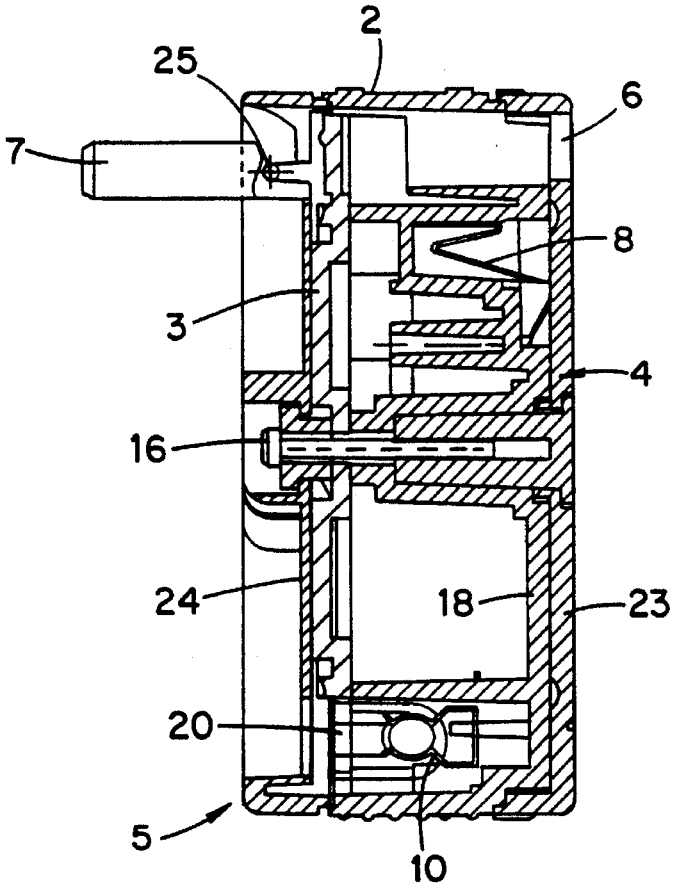
FIG. 6 is a cross section of the adaptor taken on the line X—X of FIG. 5.
Figure 7:
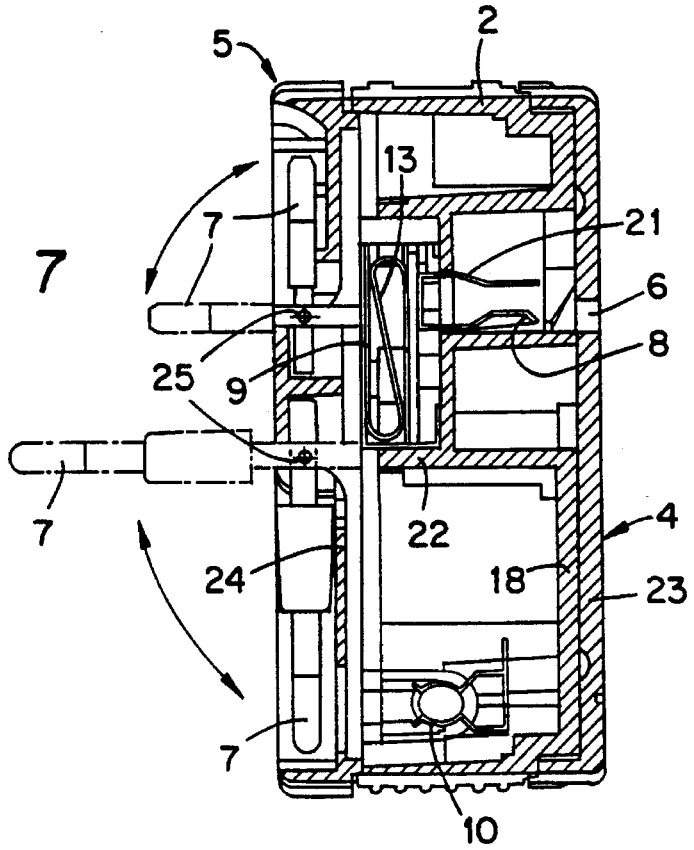
FIG. 7 is a cross section of the adaptor taken on the line Y—Y of FIG. 5.

The apertured socket end plate 23 is formed with four sets of socket apertures 6 disposed mutually at 90° to one another and may, for example comprise a U.K. set, a continental European set, a United States and Canadian set and an Australian and New Zealand set. It will be seen from FIG. 1 that those sockets in the inoperative position are blanked-off by the end wall 18 of the body 2. The plug end or carrier plate 24 is provided with four sets of plug pins 7 disposed mutually at 90° to one another and corresponding to the sockets sets mentioned above. The plug pins 7 are hinged to the plate 24 at 25 so as to be pivotable from non-operative positions in which they lie flat against the plate as shown in FIG. 2 to a working position in which they extend at right angles to the carrier plate 24 and substantially parallel to the axis of the adaptor as can be seen for example in FIG. 7. Means are provided so that only those plug pins positioned in the operative position can be folded out so that the remaining sets of pins are positively retained in their non-working position. When, and only when, the pins are folded into their working position the hinged ends of the pins make contact with the sprung contact plates 9 to provide electrical contact between the pins and the contacts. As stated above the contacts 9 are electrically connected to the first set of contacts 8 which are in turn contacted by the pins of a plug inserted into a selected one of the sets of sockets formed in the plate 23. Preferably the end plates 23, 24 are provided with markings arranged to be aligned with corresponding markings on the body 2 so that it is readily possible to identify the working positions of the sockets and plug pins.

Industrial Applicability

Thus the adaptor provides and electrical connector capable of many different configurations so that it is generally applicable world-wide but which is nevertheless simple in construction and in use. The particularly described adaptor provides a so called travel plug which provides a plurality of different socket options and a plurality of different plug pin options.

I claim:

1. An electrical connector comprising a housing having at one end a plurality of selectable pin arrays and at the other end a plurality of selectable socket arrays, a carrier member on which the plurality of pin arrays is disposed, the carrier member being adapted to be mounted on the housing in a plurality of relatively rotated positions to bring a selected one of the pin arrays into a position in which they can be moved into their operative condition one at a time, and an apertured member mounted on said other end of the housing, the apertured member being adapted to be mounted on the housing in a plurality of relatively rotated positions to bring a selected one of the plurality of socket arrays into an operative condition one at a time.

2. An electrical connector according to claim 1, characterised in that the carrier member (5) is rotatably mounted on the housing (2).

3. An electrical connector according to claim 1, characterised in that the apertured member (4) is rotatably mounted on the housing (2).

4. An electrical connector according to claim 1, characterised in that the pin arrays (7) are pivotably mounted at (25) on the carrier member (5) so as to be movable from inoperative positions in which they are retracted against the carrier member to operative positions in which they extend away from the carrier member.

5. An electrical connector according to claim 1, characterised in that the housing (2) is generally cylindrical and in that the carrier member (5) and the apertured member (4) are disc-like and are co-extensive with the axial ends of the housing (2).

6. An electrical connector according to claim 7, wherein the overall axial length of the housing (2,4,5) is less than its diameter.

7. An electrical connector according to claim 1, further comprising:

a first pair of electrical contacts resiliently mounted in the housing adjacent to the carrier member;

a second pair of electrical contacts resiliently mounted in the housing adjacent to the apertured member; and means electrically coupling said first and second pairs of electrical contacts, wherein the carrier member and the apertured member are rotatably mounted on the housing, whereby the second pair of electrical contacts are electrically coupled to a selected pin array upon rotation of the carrier member and the first pair of electrical contacts are aligned with a selected socket array upon rotation of the apertured member with respect to the housing.

* * * * *